US010328475B2

(12) United States Patent
Koechig

(10) Patent No.: US 10,328,475 B2
(45) Date of Patent: Jun. 25, 2019

(54) METHOD AND DEVICE FOR BENDING OF STRAND-SHAPED WORKPIECES

(71) Applicant: DENGLER TUBE TEC GmbH, Witten (DE)

(72) Inventor: Norman Koechig, Iserlohn (DE)

(73) Assignee: DENGLERLANG TUBE TEC GmbH, Witten (DE)

( * ) Notice: Subject to any disclaimer, the term of this patent is extended or adjusted under 35 U.S.C. 154(b) by 0 days.

(21) Appl. No.: 15/685,392

(22) Filed: Aug. 24, 2017

(65) Prior Publication Data

US 2018/0056359 A1 Mar. 1, 2018

(30) Foreign Application Priority Data

Aug. 30, 2016 (DE) ..... 10 2016 116 159

(51) Int. Cl.
*B21D 7/024* (2006.01)
*B21F 1/00* (2006.01)

(52) U.S. Cl.
CPC ..... *B21D 7/024* (2013.01); *B21F 1/006* (2013.01)

(58) Field of Classification Search
CPC ..... B21D 7/02; B21D 7/021; B21D 7/022; B21D 7/024; B21D 7/04
See application file for complete search history.

(56) References Cited

U.S. PATENT DOCUMENTS

| | | | | |
|---|---|---|---|---|
| 3,493,016 | A | 2/1970 | Ott | |
| 7,234,333 | B2 | 6/2007 | Maier et al. | |
| 10,076,779 | B2 * | 9/2018 | Jaubert | B21D 7/024 |
| 2008/0110223 | A1 * | 5/2008 | Zuber | B21D 7/02 72/309 |

FOREIGN PATENT DOCUMENTS

| | | | | |
|---|---|---|---|---|
| DE | 20301138 | U1 | 1/2003 | |
| DE | 102009038384 | A1 | 3/2011 | |
| DE | 102010013688 | A1 | 11/2011 | |
| DE | 102013200850 | A1 | 7/2014 | |
| EP | 0519865 | A1 | 6/1992 | |
| JP | 2006205215 | A | 8/2006 | |
| WO | WO-2014111638 | A1 * | 7/2014 | B21D 7/021 |

* cited by examiner

*Primary Examiner* — Pradeep C Batttula
(74) *Attorney, Agent, or Firm* — Robert W. Morris; Ojeiku Aisiku; Eckert Seamans Cherin & Mellott, LLC

(57) ABSTRACT

A device and method for bending strand-shaped workpieces are described with a holder for a strand-shaped workpiece. A bending tool comprises at least one radius part and one bending part. The workpiece can be bent by pivoting the bending part about the radius part. A workpiece drive shaft that extends at least in a longitudinal direction is provided for driving the bending tool and a positioning device for positioning the bending tool relative to the workpiece. The positioning device allows a displacement of the bending tool and the tool driveshaft in at least one transverse direction that runs transversely to the longitudinal direction. A drive wheel is rotatably arranged around an axis that is fixed relative to the workpiece and is coupled via a transmission device to drive the tool driveshaft. The transmission device has a coupling element that can move transverse to the axis of the drive wheel.

15 Claims, 9 Drawing Sheets

Fig.2
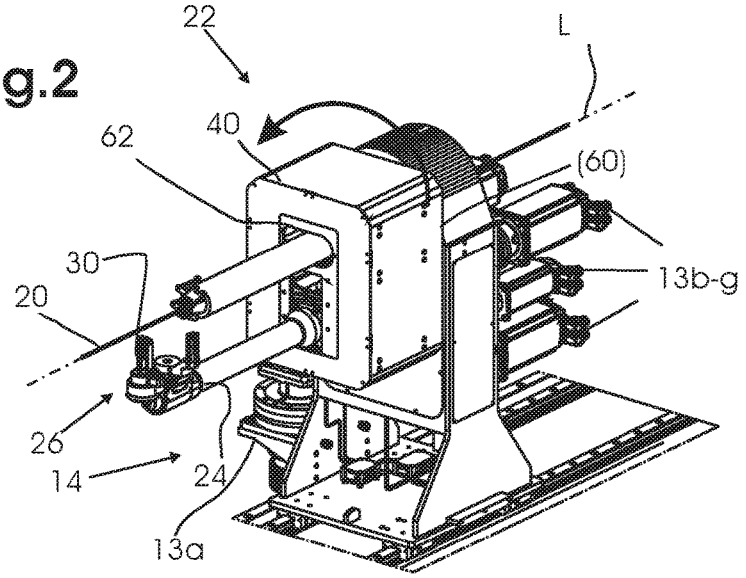
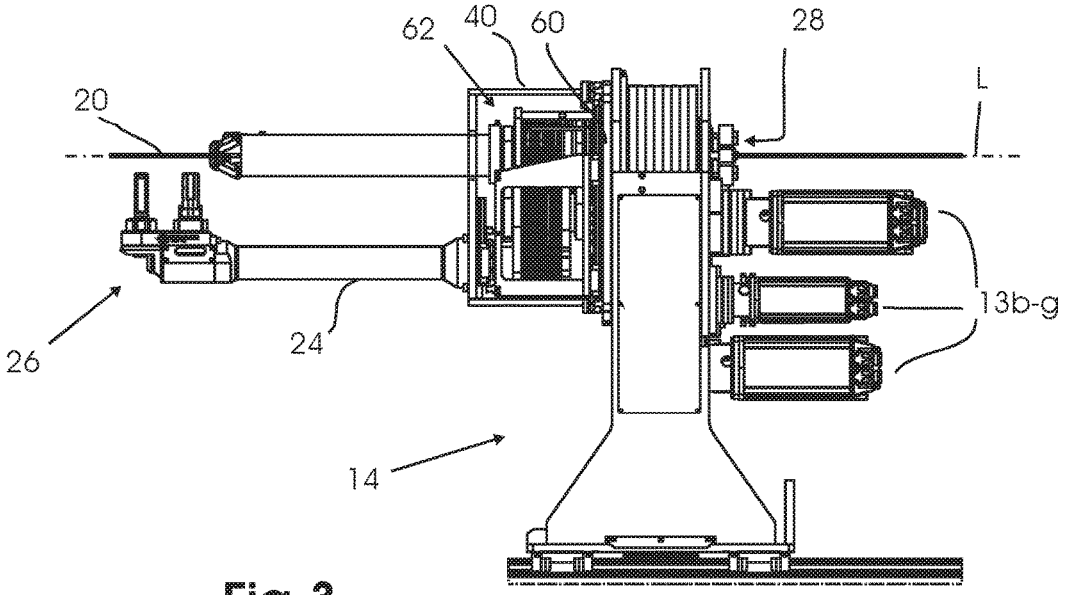
Fig.3

Fig.7
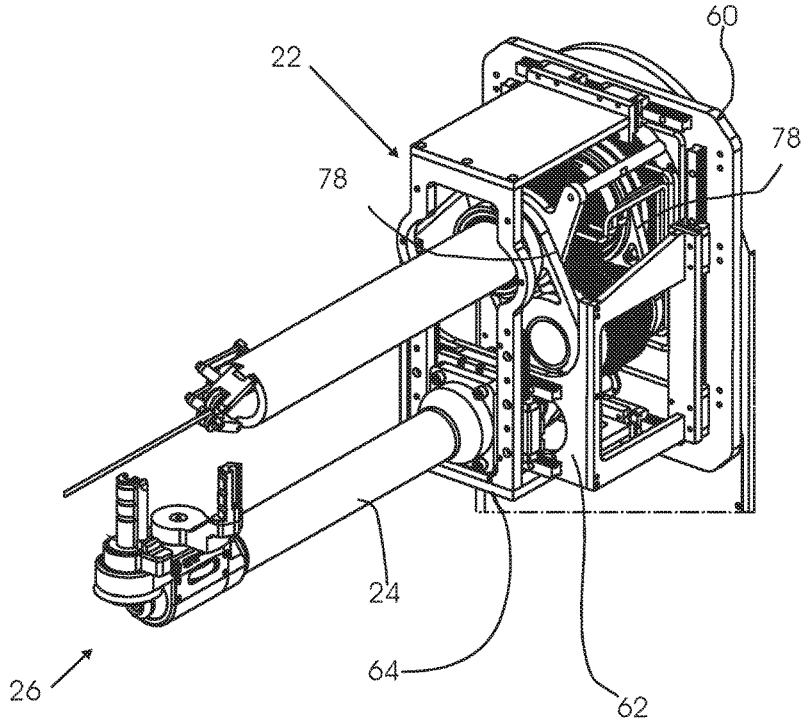
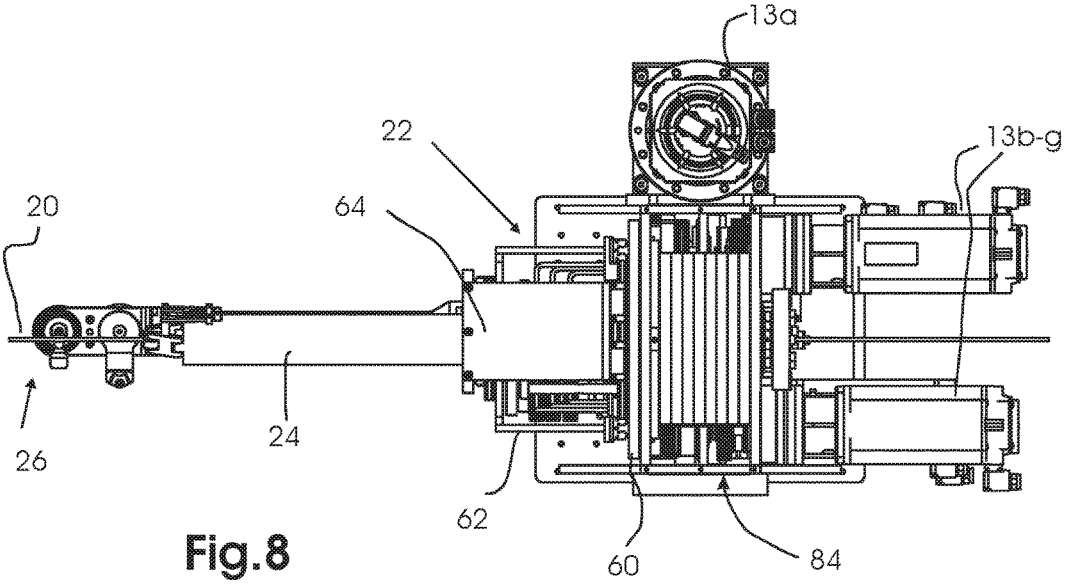
Fig.8

Fig.9
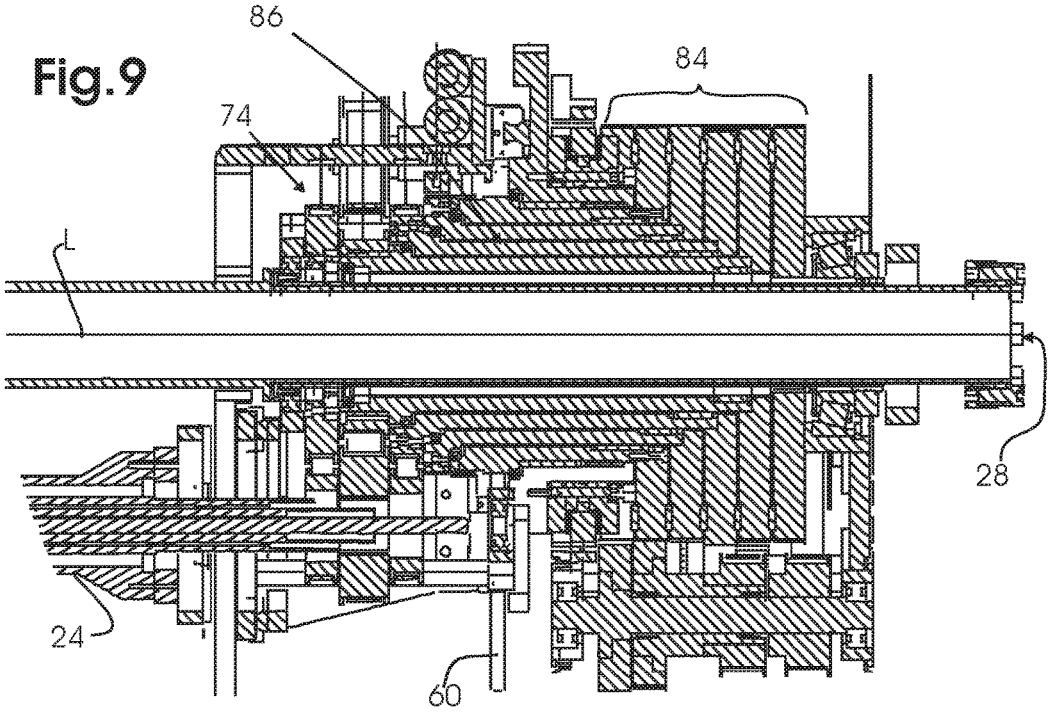
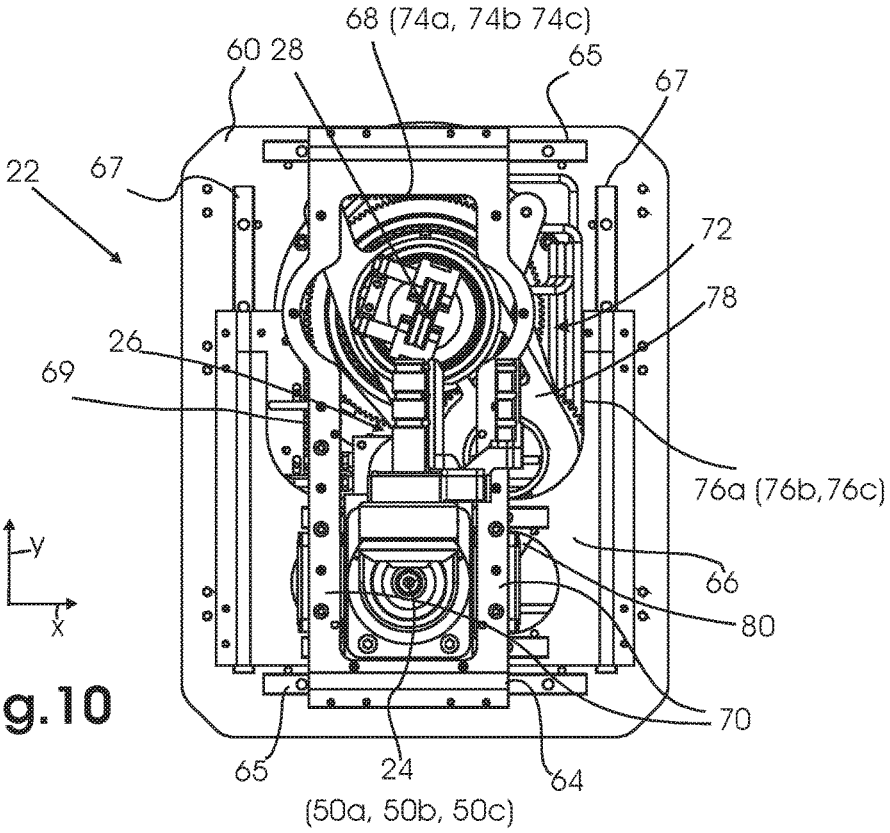
Fig.10

METHOD AND DEVICE FOR BENDING OF STRAND-SHAPED WORKPIECES

BACKGROUND OF THE INVENTION

Field of the Invention

The invention relates to a method and device for bending strand-shaped workpieces, in particular pipelines.

Description of Related Art

Various types of bending machines are known for bending e.g., fuel, brake or hydraulic lines.

DE 203 01 138 U1 describes a bending machine with a fixed clamping unit for fixing a pipe to be bent and a bending unit that can move relative thereto with a bending head to which a bending tool is attached at the end of an extension arm. The bending tool comprises a counter roller and a sliding block that can be pivoted around the counter roller. The bending tool is positioned by moving the bending head at a bending point so that the bending of the pipe is effectuated by pivoting the sliding block around the counter roller.

In EP 1 591 174, a bending device is described for rod-shaped and tubular workpieces that has a bending head with a bending mandrel and a clamping apparatus for pressing the workpiece to be bent against a shaped groove in the bending mandrel. The bending mandrel can be rotated by means of a rotary drive, and the clamping apparatus can be pivoted concentrically to the rotary axis of the bending mandrel. The bending head is connected to rotary drives that are independent of each other. To transmit the drive from the three rotary drives to the bending mandrel, conversion gears and the clamping apparatus, three rotary shafts arranged concentrically with each other are provided, each of which is connected to one of the rotary drives.

BRIEF SUMMARY OF THE INVENTION

It can be considered an object to provide a method and device for bending strand-shaped workpieces in which a wide range of bends is enabled by a particularly flexible ability to control a bending tool.

The object is achieved by a device according to claim 1 and a method according to claim 15. Dependent claims refer to advantageous embodiments of the invention.

A device according to the invention comprises a holder for a strand-shaped workpiece. A strand-shaped workpiece is understood to be an elongated, preferably at least substantially cylindrical workpiece such as a rod or a pipe. The workpiece can be consistently homogeneous, i.e., for example an unchanging material, preferably metal, and can have a consistent diameter. It is likewise also possible for the workpiece to have different sections, such as connections or thicker regions in the middle or at the ends, sections with different diameters, flexible sections, etc. It is generally preferable for the workpiece to be straight at the start of processing. Since the currently preferred embodiments of the invention were developed with regard to the processing of pipes, the workpiece will also be occasionally termed a pipe in the following to simplify the description. This however should not be understood as a restriction, a person skilled in the art will discern that the device according to the invention and the method according to the invention can be likewise applied to other strand-shaped workpieces.

The holder according to the invention for the workpiece secures the workpiece at least sectionally and temporarily within the device so that processing by a bending tool is possible. In preferred embodiments, the holder comprises at least one clamping device for clamping the workpiece. Moreover, a bushing can be provided for the workpiece. The clamping device preferably serves to clamp an unbent section of the workpiece, preferably a pipe end.

According to the invention, the device moreover comprises a bending tool by means of which a bend in the workpiece can be created at a desired bending point. Generally, the bending tool comprises at least one radius part and one bending part that preferably can be placed on opposite sides of the bending tool. A bend can accordingly be created by swinging the bending part about the radius part. The radius part and/or the bending part can preferably be each designed as rollers.

According to the invention, a tool driveshaft is provided to drive the bending tool. The tool driveshaft serves to transmit a rotary movement to elements of the bending tool, in particular preferably to the radius part and/or bending part. On the one hand, this can provide the necessary force to create the bend; on the other hand, the bending movement can be precisely controlled in order for example to achieve a desired bend angle.

To create a desired bend geometry, the bending tool can preferably be variably positioned relative to the workpiece. Preferably, the bending tool and/or the workpiece can be moved in its longitudinal direction; more preferably, the workpiece and bending tool can also pivot about the longitudinal direction relative to each other. It is particularly preferable to fixedly arrange the workpiece and suitably position the bending tool relative to the fixed workpiece, for example by rotating, displacing or moving.

According to the invention, a positioning device is provided in order to position the bending tool relative to the workpiece so that the bending tool and the tool driveshaft connected thereto can also be displaced in a transverse direction. The transverse direction is transverse, i.e., at least substantially perpendicular to the longitudinal direction of the workpiece driveshaft. The positioning device allows a displacement in at least one direction transverse to the longitudinal direction, preferably in different transverse directions.

To drive the tool driveshaft, a drive wheel is provided that is coupled to the tool driveshaft by a transmission device. The drive wheel can rotate about an axis that is fixed relative to the workpiece. As is discernible in the preferred embodiments described below, the drive wheel is preferably rotatably arranged about the longitudinal axis of the workpiece. A drive device such as a motor drive can preferably be provided to drive the drive wheel.

According to the invention, the transmission device has at least one coupling element that is movable transversely to the axis of the drive wheel. For example, the position of the coupling element can be adjustable in a transverse direction. Given its mobility in a transverse direction, the coupling element can enable a transmission of the drive movement from the drive wheel to the workpiece driveshaft. The coupling element can be any type of one or more parts suitable for transmitting a rotary movement, such as belts, chains, shafts, gears, etc. Preferably, it is a single gear that can be displaced transverse to its rotary axis.

With the assistance of the coupling element that can be moved in a transverse direction, the rotary movement can nonetheless be continuously transmitted from the fixed drive wheel to the workpiece driveshaft, and hence to the bending tool, despite the displacement of the bending tool and the tool driveshaft in a transverse direction. Accordingly, a very flexible positioning is enabled while the bending tool can still be precisely driven. Highly variable different bends and bending geometries can be achieved by the accordingly very flexible positioning of the bending tool relative to the workpiece.

Displacing the bending tool in a transverse direction, i.e., for example as a lift in the vertical direction or an offset in the horizontal direction (relative to a horizontally arranged workpiece) enables highly flexible bending positions and movements to be controlled. For example, a lift can be used to bring different pipe sections specifically into contact with different sections of the elements of the bending tool, for example in that grooves of different sizes in the radius part, or respectively in the bending part, are specifically brought into contact with the workpiece by adjusting the lift. An offset of the bending tool relative to the workpiece can in particular be used to change the contact side of the radius part and bending part, i.e., enable bending to the right, or respectively to the left. By a combined lift/offset movement, the bending tool that was previously positioned on one side of the workpiece can for example pass under the workpiece and be positioned thereupon on the other side.

By driving the bending tool with the tool driveshaft, different movable elements of the bending tool can preferably be specifically moved and thus be brought into desired positions. Primarily, this relates to a pivoting movement of the bending part about the radius part in order to create a bend of the workpiece by a desired bending angle. Moreover, the radius part, preferably designed as a radius roller, can also for example be rotated about its own axis so that both bending by rolling and drawing are enabled. Moreover, at least one additional movable element can be provided on the bending tool, for example a counter holder that is pivotable, or respectively movable, in order to be placed on the side of the workpiece during bending. For each drive of one of the aforementioned movable elements of the bending tool, a separate tool driveshaft can be provided, wherein the shafts are preferably arranged parallel, and particularly preferably coaxial, i.e., at least partially as hollow shafts.

For a plurality of tool driveshafts, preferably a plurality of coupling elements and a plurality of drive wheels are provided. Preferably, the drive wheels and coupling elements can each be arranged axially next to each other and coaxially driveable.

In all of the movements enabled by displacing the tool driveshaft, coupling with the fixed drive wheel can always be retained so that drivable elements of the bending tool can still be precisely positioned.

According to one preferred embodiment of the invention, the holder is designed so that the workpiece is aligned in a longitudinal direction, i.e., the tool driveshaft establishing the longitudinal direction is aligned parallel to the longitudinal direction of the workpiece. Such an arrangement is particularly preferred to achieve a minimal "interfering edge". The parts attached to the bending tool constitute a restriction to the achievable bending geometries, i.e., the bends that can still be achieved without striking the bent end of the pipeline. A small interfering edge is of decisive importance, for example with complicated bend geometries, in particular with larger bending angles. The arrangement of the tool driveshaft parallel to the longitudinal axis of the still unbent workpiece can significantly reduce the disturbing edge.

According to a further embodiment of the invention, the positioning device comprises at least one slide that can be displaced in a transverse direction (i.e., transversely to the longitudinal direction established by the progression of the tool driveshaft, preferably also transversely to the longitudinal axis of the workpiece). Such a slide is preferably guided in the transverse direction. The guide can for example be designed as a sliding guide, and preferably is a rail guide. To move the slide, at least one slide drive device can be provided, preferably with an advancing element to convert a rotational movement into a linear movement. Such an advancing element can for example be formed by a worm drive; preferably, a toothed rack engaged with a pinion is used. The slide is preferably coupled to the tool driveshaft to be able to move it in the transverse direction. In particular, the slide can enclose the tool driveshaft and thereby laterally guide it in at least one direction to realize positioning in the transverse direction with simultaneous free rotatability.

To achieve positionability that is as free as possible, a first and second slide can be provided according to a preferred embodiment. The first slide is movably guided in a first transverse direction, and the second slide is movably guided in a second transverse direction that runs at an angle, preferably a right angle to the first transverse traction. Accordingly, desired movements can be achieved such as a lift or offset. This makes it possible for the second slide to be movably guided on the first slide. It is likewise possible for the guides of the slides to be arranged separate from each other, wherein the slides then form side guides for the element arranged thereupon, preferably the tool driveshaft.

In one preferred embodiment, the positioning device enables the bending tool to rotate around the longitudinal direction of the tool driveshaft, and preferably also around the longitudinal direction of the workpiece. Accordingly, the bending direction can be set by correspondingly rotating the bending tool, preferably relative to a fixed workpiece. To achieve the rotation, a support for the tool drive shaft can be rotatably arranged around a rotary axis aligned in the longitudinal direction. It is preferable that also the transmission device and/or guides, and possibly drives for displacing in a transverse direction are arranged on the rotatable carrier, for example the above-described slides.

For the transmission device, it is preferable for the drive wheel to be designed as a drive gear, and for a drive pinion to be provided on the tool driveshaft. Particularly preferably, the coupling element can be designed as a coupling gear which is engaged with the drive pinion and the drive wheel. For example, the coupling gear can be connected in each case to the tool driveshaft and the drive gear by at least one spacing element such as a tab so that the distance remains constant, and the coupling gear always remains engaged with the drive pinion and the drive gear even when the drive pinion moves in the transverse direction. An example of such an arrangement will be further explained below in the preferred embodiment.

The arrangement of a coupling gear always allows the transmission of a desired rotary movement from the drive gear to the drive pinion, and via the tool driveshaft to the bending tool, even when the tool driveshaft is displaced in a transverse direction, i.e., in a lift or offset. Accordingly, coupling can always be sustained, and the position of drivable elements of the bending tool can always be appropriately established independent of lift and offset.

In one preferred embodiment, the drive wheel is coupled to at least one motor drive, such as via a gearing, shaft, chain, belt drive, etc. The motor drive comprises a motor such as an electric motor and can moreover comprise further elements such as a rotary position sensor, gearing, etc.

Preferably, an activation device is provided for activating the motor drive. It is particularly preferable for the activation device to specify an activation of the motor drive depending on the displacing of the bending tool in the transverse direction. Because, by means of the coupling element, a displacement in the transverse direction can accordingly bring about a relative rotation, for example of a drive pinion of the tool driveshaft relative to the drive wheel. This can change in the rotary angle relationship between the drive wheel and the drive pinion depending on the displacement. By taking into account the rotary angle relationship depending on the displacement, incorrect activation can be avoided, or respectively in an ideal case, any influence of the displacement on the rotary position can be avoided.

It is particularly preferable to use a compensating rotation of the drive wheel when a displacement is executed in the transverse direction. The activation device stipulates a compensating rotation of the drive wheel in a manner such that a change in the rotary angle relationship caused by the displacement between the drive wheel and the drive pinion is compensated by the compensating rotation. Accordingly, the rotary position of the drive pinion can be retained during displacement despite ongoing coupling.

According to one preferred embodiment of the invention, the drive wheel can be coupled to a drive disk via a transmission shaft, wherein the drive disk can be driven directly or indirectly by a motor drive. It is particularly preferable to provide not just one drive wheel, but rather to rotatably arrange at least one or preferably a plurality of additional drive wheels around the same rotary axis as the first drive wheel, preferably axially adjacent to each other. In one preferred embodiment, the drive wheels are coupled via coaxial hollow shafts respectively to associated drive disks that also can be axially arranged adjacent to each other. In this context, it has proven to be particularly useful to provide a bushing for the workpiece within the hollow shafts. This allows drive power to be transferred from one or preferably a plurality of motor drives via the drive disks and hollow shafts to one or preferably a plurality of drive wheels. Given the workpiece bushing, the entire arrangement can be rotated about the longitudinal axis of the workpiece.

The aforementioned additional drive wheels can be provided for various functions. For example, at least one drive wheel can serve to drive the displacement of the bending tool in a transverse direction. Preferably, two drive wheels are used for this in order to enable lift and offset. Moreover, at least one drive wheel can serve to rotate the bending tool about the longitudinal direction of the tool driveshaft (or about the longitudinal axis of the workpiece).

BRIEF DESCRIPTION OF THE SEVERAL VIEWS OF THE DRAWINGS

In the following, embodiments of the invention will be further described with reference to the drawings. In the drawings:

FIG. 2 shows a perspective view of the bending tower of the bending machine from FIG. 1 with a bending head.

FIG. 3 shows a side view of the bending tower and bending head from FIG. 2 with a partially removed housing.

FIG. 7 shows a perspective view of the bending head from FIG. 2 without a housing;

FIG. 8 shows a plan view of the bending head from FIG. 7 without a housing.

FIG. 9 shows a representation in a longitudinal section of hollow shafts with drive wheels of the bending head.

FIG. 10 shows a front view of the bending tool from FIG. 7, 8 with elements of a coupling device.

DETAILED DESCRIPTION OF THE INVENTION

Figure 1A:
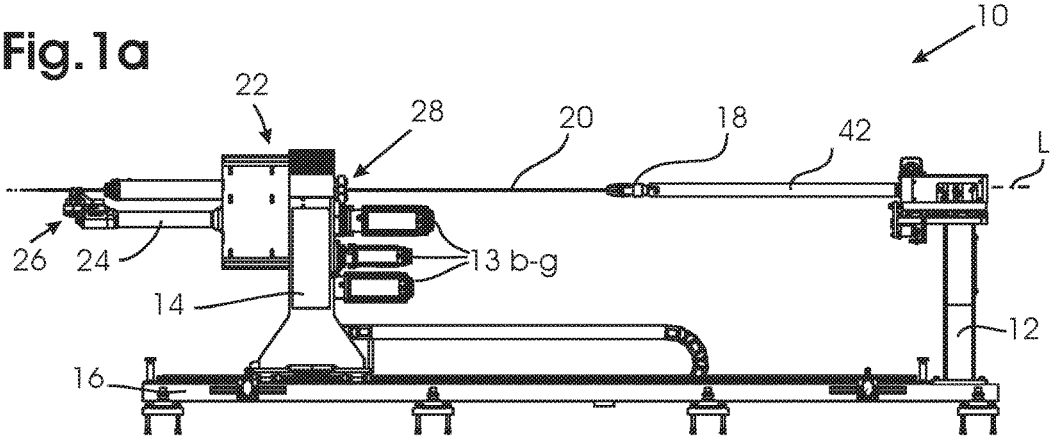
FIG. 1*a*-1*c* show side views of a pipe bending machine with a bending tower in different positions.
Figure 1B:
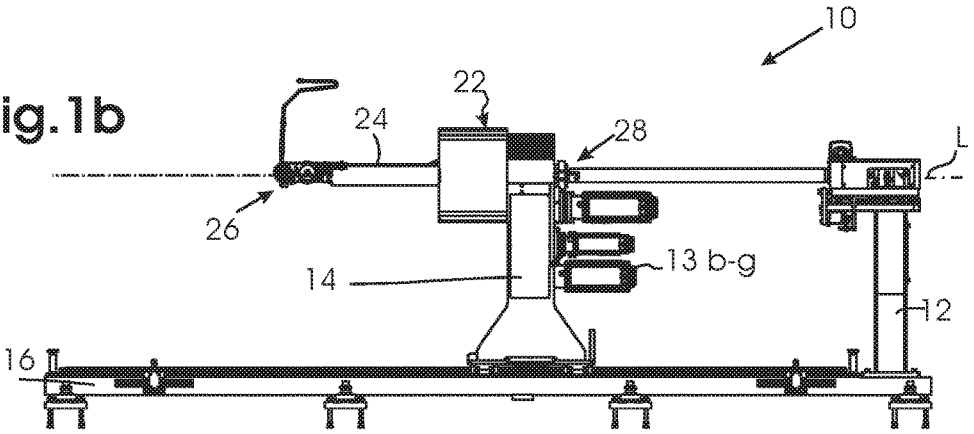
Figure 1C:
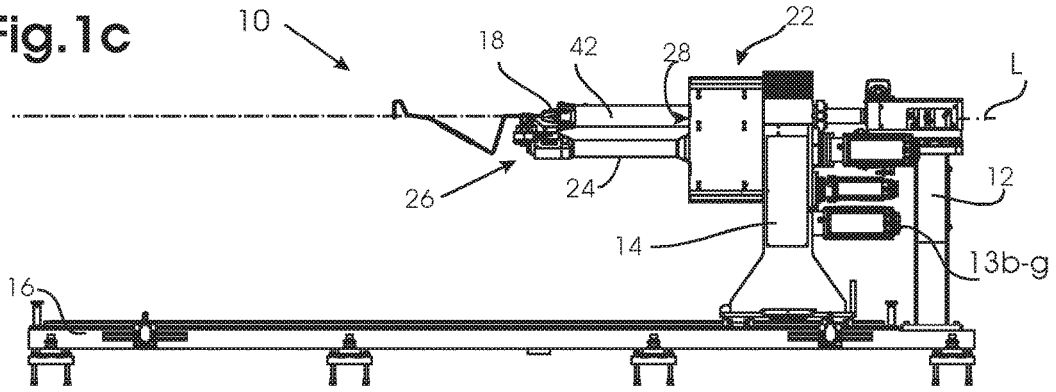

FIG. 1*a*-1*c* show a pipe bending machine 10 with a fixed clamping unit 12, relative to which a bending tower 14 in a machine bed 16 can be moved in a longitudinal direction L.

The bending tower 14 bears a bending head 22 to which a bending tool 26 is attached by a tool holder 24. The bending head 22 can rotate about a longitudinal axis L. Controllable drives 13*a* (not shown in FIG. 1) and 13*b*-*g* are provided for moving the bending tower 14 and rotating the bending head 22. The individual functions of the drives 13*a*-*g* will be explained in greater detail below.

In FIG. 1*a*, an unbent pipeline 20 is securely clamped in a clamping head 18 of the clamping device 12 so that the pipe 20 is aligned in the longitudinal direction of the axis L. The clamped pipe end remains consistently stationary during the bending process and is not moved or rotated. The bending head 22 has an opening 28 of an axially running passage through which the pipe 20 is inserted. The bending tool 26 is positioned on the pipe 20.

While the pipe bending machine 10 is operating, the pipe 20 is shaped into a desired bend geometry by the bending tool 26 by applying successive bends as can be seen from the sequence in FIG. 1*a* to 1*c*. First the bending point at the furthest distance from the clamped end of the pipe 20 is approached, and the bending tool 26 is positioned there. By means of a rotating mechanism which will be explained further below, the bending head 22 can be rotated about the longitudinal axis L of the pipe 20 so that the bending tool 26 also rotates conjointly and can be activated to create a bend about a bending axis running transverse to the longitudinal axis L.

Figure 4:
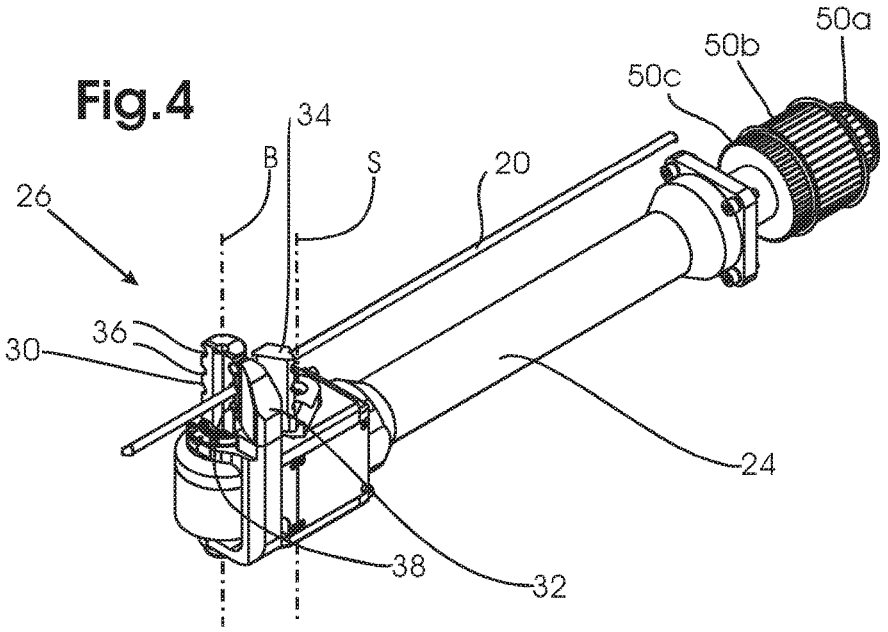
FIG. 4 shows a perspective view of a tool holder of the bending head from FIG. 2, 3.

The elements of the bending tool 26 can be seen more precisely in FIG. 4, 5. As movable, driven elements, the bending tool 26 comprises a radius roller 30 that can rotate about a bending axis B, a sliding block 32 that can pivot about the bending axis B, and a counter holder 34 that can pivot about a pivot axis S.

Figure 5:
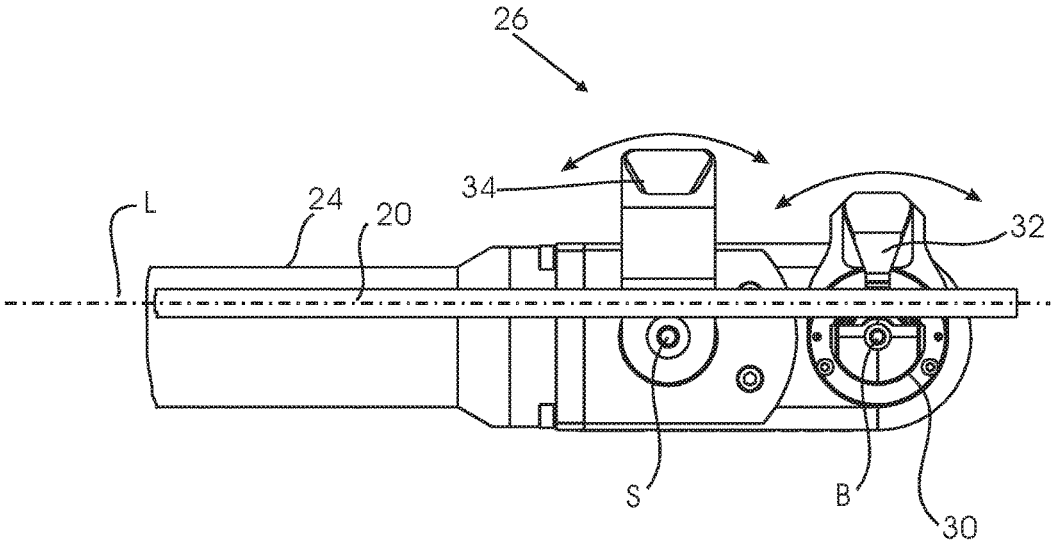
FIG. 5 shows a plan view of the bending tool from FIG. 4.

As can be seen in FIG. 4 and also in FIG. 5, the radius roller 30 comprises a plurality of bending grooves 36 at a distance from each other in the longitudinal direction of the radius roller 30 that each extend around a part of the circumference of the radius roller 30. The sliding block 32 comprises associated bending grooves 38 at the same spacing which are arranged on the side of the bending roller 32 facing the radius roller 30.

To create a bend in the pipeline 20, it is accommodated between the radius roller 30 and the sliding block 32 in one of the radial grooves 36 and one of the bending grooves 38.

The different radial grooves 36 and associated bending grooves 38 are provided to accommodate pipelines of different outer diameters.

By pivoting the sliding block 32 about the bending axis B, a bend of the pipe 20 is generated in a bending plane perpendicular to the bending axis B while simultaneously rotating the radius roller 30.

The sliding block 32 is pivotably arranged around the radius roller 30. The radius roller 30 is rotatable. Bending by rolling as well as drawing is accordingly possible with the bending tool 26. The sliding block 32 can be pivoted about the radius roller 30 within a pivoting range of at least 180°. Depending on the actuation of the radius roller 30 and sliding block 32 in the bending plane, a bend both to the right and left is possible.

If required by the respective bend which in particular can be the case when bending pipelines with flexible sections, the pivotable counter holder 34 can be placed on the side of the pipe 20. As a lever, the counter holder 34 can pivot about the pivot axis S that runs parallel from the bending axis B at a distance. The counter holder 34 can be moved into the suitable pivot position for each bend. Various grooves to be placed against the side of the pipe 20 are provided one above the other in the counter holder 34 as well.

In order to shape the initially unbent pipe 20 into a desired bending geometry, a plurality of bends are made sequentially in the above-described manner, wherein the bending tool 26 is relatively positioned at the next bending point by moving the bending tower 14 (see FIG. 1*a*-1*c*) along the longitudinal direction L toward the clamping device 12, then, by rotating the bending head 22, the bending tool 26 is positioned about the pipe axis L in the desired bending plane, and subsequently the radius roller 30, sliding block 32, and if applicable counter roller 34 are actuated to create the desired bend.

FIG. 1*a*-FIG. 1*c* sequentially show how the bending tower 14 gradually approaches the clamping device 12 when creating the sequential bends. In so doing, the clamping head 18 arranged on an extension 42 of the clamping device 12 is guided through the opening 28 and passage in the bending head 22 until the last bend is performed. The bent pipe can then be removed.

As shown in FIG. 1*a*-FIG. 1*c* and as can be seen in greater detail in FIG. 2, 4, only the bending tool 26, from which extends only the elongated, relatively thin tool holder 24, is arranged directly on the pipe 20. Since the tool holder 24 is aligned in the longitudinal direction L and extends toward the clamping device 18, a design is achieved in which, proceeding from the bending point, there is only a very small interfering edge, i.e., fixed parts of the bending tool 26, or of its attachment (tool holder 24), which the pipeline can strike when bending, in particular at large bending angles.

In this process the tubular tool holder 24 serves not only to hold and position the bending tool 26, but also to drive the movable elements 30, 32, 34 of the bending tool 26.

Figure 6:
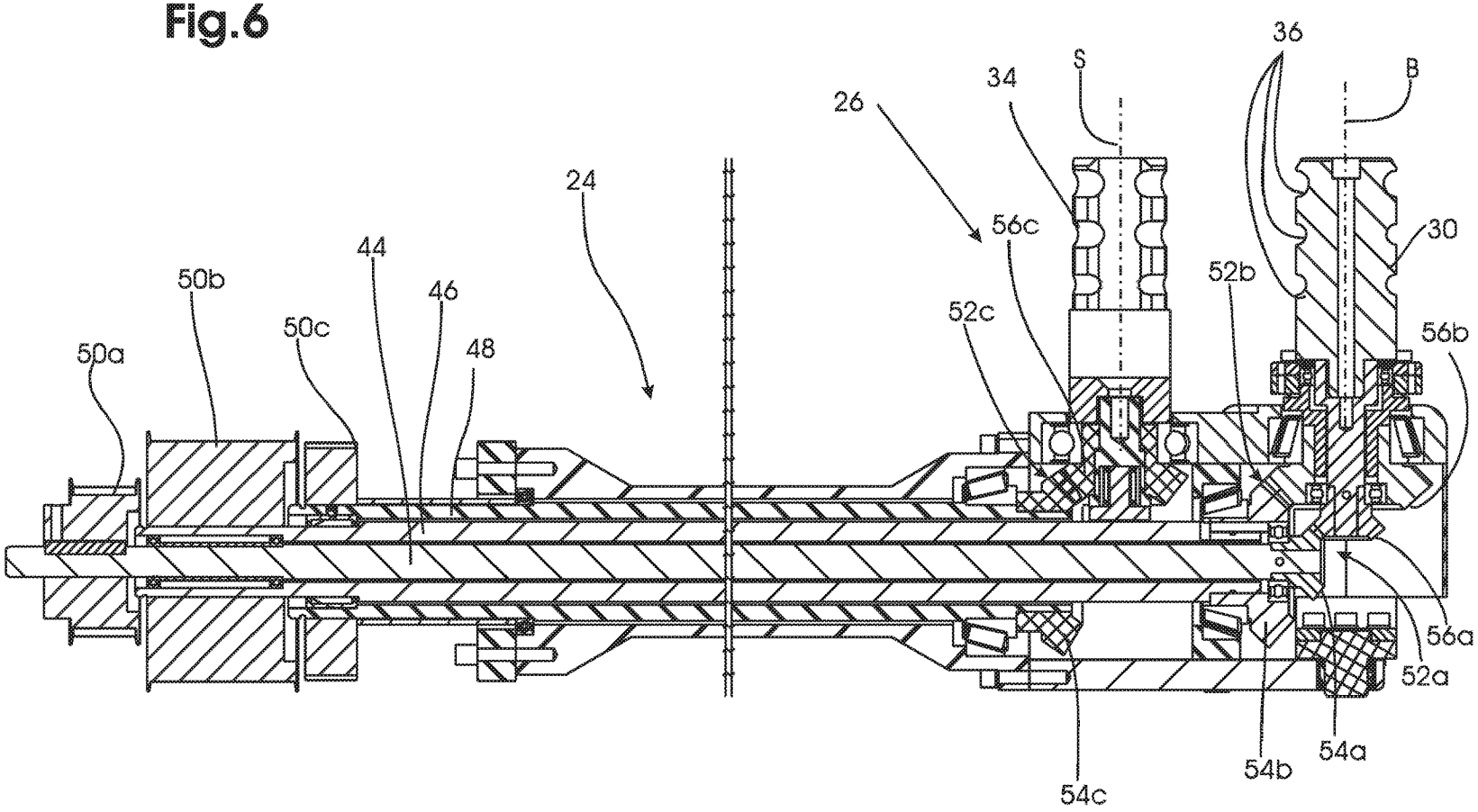
FIG. 6 shows a view of the tool holder from FIG. 4 in a longitudinal section.

As can be seen from the longitudinal section in FIG. 6, the tool holder 24 is a hollow pipe that is fastened at one end to the bending tool 26 and at the other end to the bending head. FIG. 6 does not show the entire length of the tool holder 24; in fact, the tool holder is about six times as long as it is wide as, for example, can be seen in FIG. 2, 4.

Three shafts are coaxially arranged within the interior of the tool holder 24. A solid inner shaft serves as a radius driveshaft 44. A hollow shaft arranged around the radius driveshaft 44 serves as a bending driveshaft 46. Also arranged around the bending driveshaft 46 coaxial thereto is another hollow shaft as a counter holder driveshaft 48.

As can be seen in FIG. 4 and FIG. 6, three drive pinions 50*a*, 50*b*, 50*c* that are arranged axially next to each other are provided on the inner end of the tool holder 24. As can be seen in FIG. 6, the radial inner radius driveshaft 44 is coupled to the rear-most drive pinion 50*a*, the bending driveshaft 46 is coupled to the middle pinion 50*b*, and the outer counter holder driveshaft 48 is coupled to the front pinion 50*c*.

As shown in FIG. 6, the rotary movement of the three tool drive shafts 44, 46, 48 is transmitted by corner gears to the radius roller 30, sliding block 32 and counter holder 34.

For this purpose, corner gears are always provided on the outer end of each of the tool drive shafts 44, 46, 48 by means of which the rotary movement is deflected by bevel gears at an angle of 90° in the depicted example. A first corner gear 52*a* is formed between a first bevel gear 54*a* formed on the end of the radius driveshaft 44 and a second bevel gear 56*a* coupled to the radius roller 30. A second corner gear 52*b* is formed between a first bevel gear 54*b* formed on the end of the bending driveshaft 46 and a second bevel gear 56*b* coupled to the bending roller 32. The bevel gears 54*a*, 56*a* of the first corner gear 52*a* are designed solid, whereas the bevel gears 54*b*, 56*b* of the second corner gear 52*b* are designed hollow and are arranged coaxial to the bevel gears 54*a*, 56*a* of the first corner gear 52*a*. In this manner, rotary movements of the drive pinions 50*a*, 50*b* are transmitted via the coaxial tool drive shafts 44, 46 and converted into coaxial rotations of the radius roller 30 and sliding block 32.

A third corner gear 52*c* is formed on the bending tool 26 at a distance from the first and second corner gear 52*a*, 52*b*. For this purpose, the counter holder driveshaft 48 is designed somewhat shorter than the two other tool driveshafts 44, 46. A first bevel gear 54*c* is arranged on its end and engages with a second bevel gear 56*c* which is arranged around the pivot axis S of the counter holder 34. In this manner, a rotary movement of the drive pinion 50*c* can be transmitted by the counter holder driveshaft 48 and corner gear 52*c* to the counter holder 34.

Accordingly, the movable elements 30, 32, 34 on the bending tool 26 can be rotatably driven independently and separate from each other in order to execute desired rotary, or respectively pivoting movements to create desired bends. In doing so the achievable movements are not thereby restricted, so that bends to the right/left are also enabled as well as rolling/draw bending as desired.

In this process the tool holder 24 makes it possible for the bending tool 26 to be suitably positioned by the bending head 22 in each case, wherein at the same time a drive of the elements 30, 32, 34 of the bending tool 26 is achieved in an extremely compact arrangement with a small interfering edge.

To position the bending tool 26, the bending head 22 is rotatably arranged about the longitudinal axis L of the pipe 20 as indicated by an arrow in FIG. 2. The bending head 22 has a housing 40 in which a positioning device 62 for the tool holder 24 is arranged on a head plate 60. The housing 40 can be rotated about the longitudinal axis L of the pipe 20 so that the positioning device 62 arranged therein also rotates about the longitudinal axis L with the tool holder 24 and the bending tool 26.

As can be seen in particular in FIG. 10, the positioning device 62 comprises a first slide 64 and a second slide 66. The slides 64, 66 are each guided in associated rail guides 65,67 on both sides so that the first slide 64 can be displaced to execute an offset movement in a first transverse direction X (in FIG. 10), and the second slide 66 can be displaced to execute a lifting movement in a second transverse direction Y at a right angle thereto. In doing so the slides 64, 66 are driven by the engagement of drive gears in toothed racks 68, 69.

The first slide 64 forms a side guide by two side frame elements 70 for the tool holder 24 in the X direction, whereas the second slide 66 forms a guide in the Y direction for the tool holder 24. The tool holder 24 can accordingly be displaced in a plane parallel to the head plate 60 into a desired X/Y position so that the bending tool 26 attached thereto executes the desired lift/offset movement.

In order to ensure that the drive shafts 44, 46, 48 held in the tool holder 24 are consistently driven despite the displaceability of the tool holder 24, a transmission device 72 is provided on the bending head 22. For each of the three tool driveshafts 44, 46, 48, this comprises the associated pinion (FIG. 6) 50*a*, 50*b*, 50*c*, a drive wheel 74*a*, 74*b*, 74*c* each of which being fixedly arranged to the bending head 22, and a coupling gear 76*a*, 76*b*, 76*c* each of which being engaged with the respective pinion 50*a*, 50*b*, 50*c* and drive wheel 74*a*, 74*b*, 74*c*.

The transmission device 72 is depicted in FIG. 11 once again without housing elements and without the slides 64, 66. The drive wheels 74*a*, 74*b*, 74*c* are connected by first spacing tabs 78 to the coupling gears 76*a*, 76*b*, 76*c*, and these are connected via second spacing tabs 80 to the drive pinions 50*a*, 50*b*, 50*c* on the tool holder 24. A consistent distance and hence continuous engagement between the gears is ensured by the tabs 78, 80.

Figure 12A:
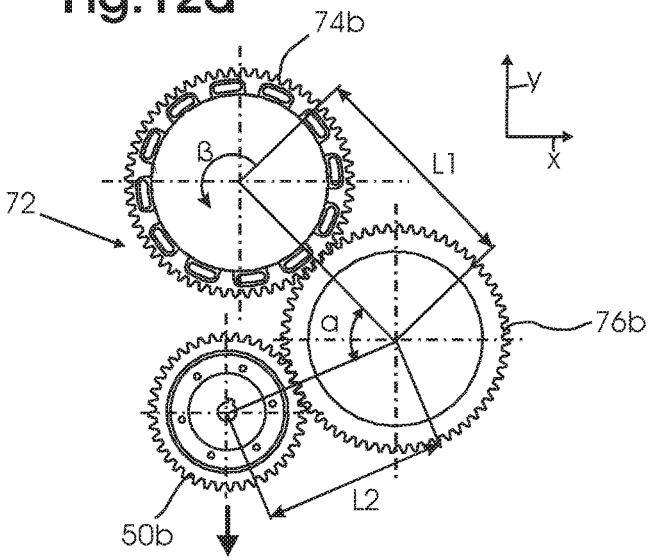
FIG. 12*a*-12*c* show front views of elements of the coupling device in different positions.
Figure 12B:
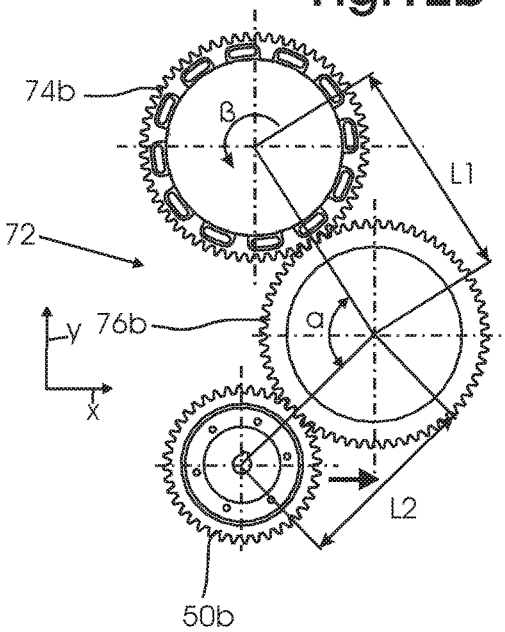
Figure 12C:
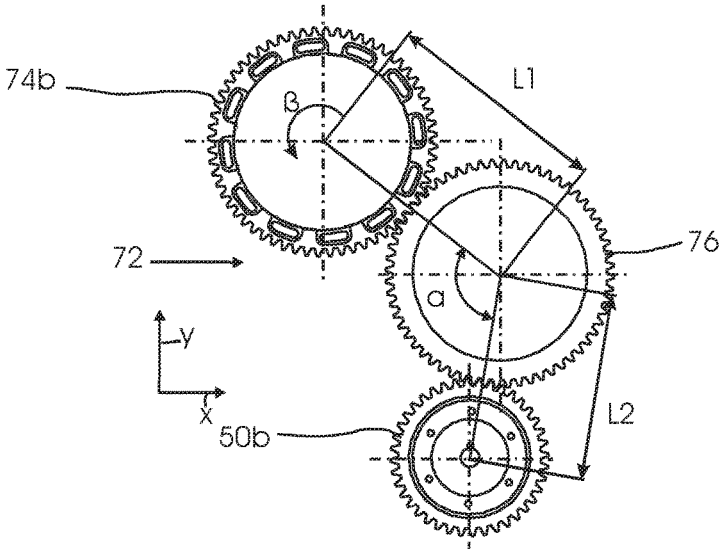

FIG. 12*a* to 12*c* shows an example of the transmission device 72 with reference to the second drive pinion 50*b*, the associated coupling gear 76*b* and the second drive wheel 74*b* provided therefor. This depiction equally applies to all three drive wheels 74*a*, 74*b*, 74*c*, coupling gears 76*a*, 76*b*, 76*c*, and drive pinions 50*a*, 50*b*, 50*c*.

Here the drive wheels 74*a*, 74*b*, 74*c* are arranged on a rotary axis fixed to a bending head 22, i.e., around the pipe penetration 28. By positioning the tool holder 24, the drive pinions 50*a*, 50*b*, 50*c* are moved by means of the slides 64, 66 (not shown in FIG. 12*a*-12*c*) in the X and Y direction. By means of the space tabs 78, 80 (also not shown in FIG. 12*a*-12*c*), the distances L1, L2 between the gears remain unchanged. Consequently as shown in FIG. 12*a* to 12*c*, the drive pinion 50*b* can be variably positioned in the X and Y direction relative to the fixed drive wheel 74*b*, wherein the coupling gear 76*b* then assumes in each case an appropriate intermediate position so that engagement is consistently ensured.

Independent of the X/Y position of the drive pinion 50*b*, coupling is always retained so that a rotating drive by the drive wheel 74*b*, and correspondingly the precise establishment of the rotary position of the drive pinion 50*b*, remain ensured in each position.

However, an altered angular relationship of the two gears relative to each other results by displacing the drive pinion 50*b* relative to the drive wheel 74*b*. This depends on the angle $\alpha$ between the axes in each case formed by the coupling gear 76*b* with the drive wheel 74*b* and the drive pinion 50*b*. Based on the design parameters of the gears, i.e., their respective radius and number of teeth, a correction, or respectively compensation angle $\beta$, can accordingly be calculated or determined by experiments for each X/Y displacement of the drive pinion 50*b* by which the drive wheel 74*b* can be rotated in order to achieve a fixed rotary position of the drive pinion 50*b* despite the displacement. The respective correction, or respectively compensation angle $\beta$ can be considered a term to be subtracted in the activation, i.e., if rotation is desired in the displacement and not a fixed rotary position of the drive pinion 50*b*, the compensation angle can be subtracted from the rotary angle to be specified.

Figure 13:
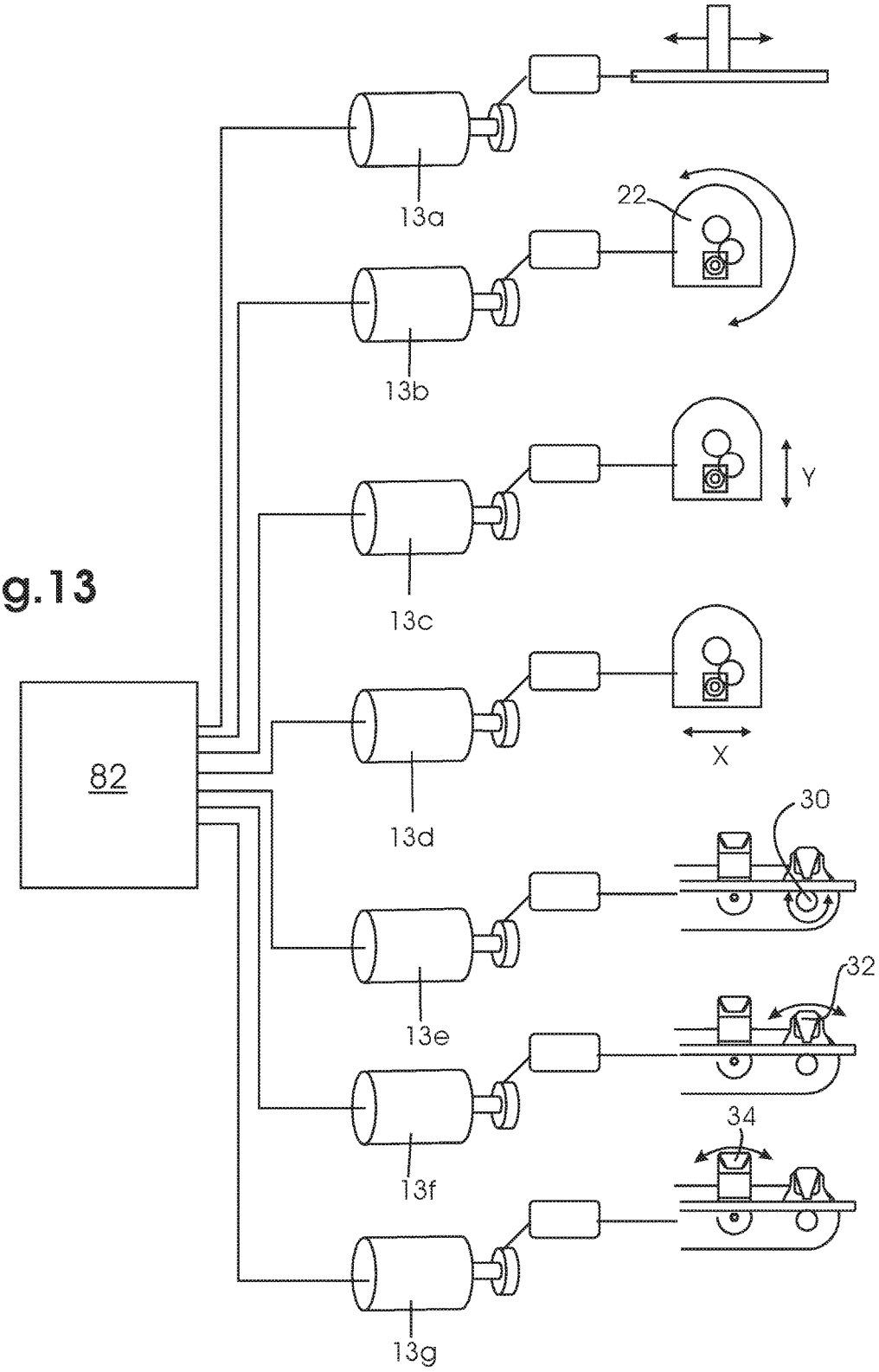
FIG. 13 shows a schematic representation of an activation device for different motor drives.

The activation and hence the precise positioning and movement of the bending tool 26 relative to the pipe 20 is effectuated by the motor drives 13*a*-13*g* already mentioned. These are always position-controlled electric motors which are activated by a central control device 82 as schematically portrayed in FIG. 13.

A first motor drive 13*a* serves to move the bending tower 14 in the longitudinal direction, such as by a worm drive or rack and pinion drive (not shown).

As can be seen in particular in FIG. 3, the motor drives 13*b* to 13*g* are arranged on the rear of the bending tower 14. They are each coupled by belts to a number of drive disks 84 arranged axially adjacent to each other.

Figure 11:
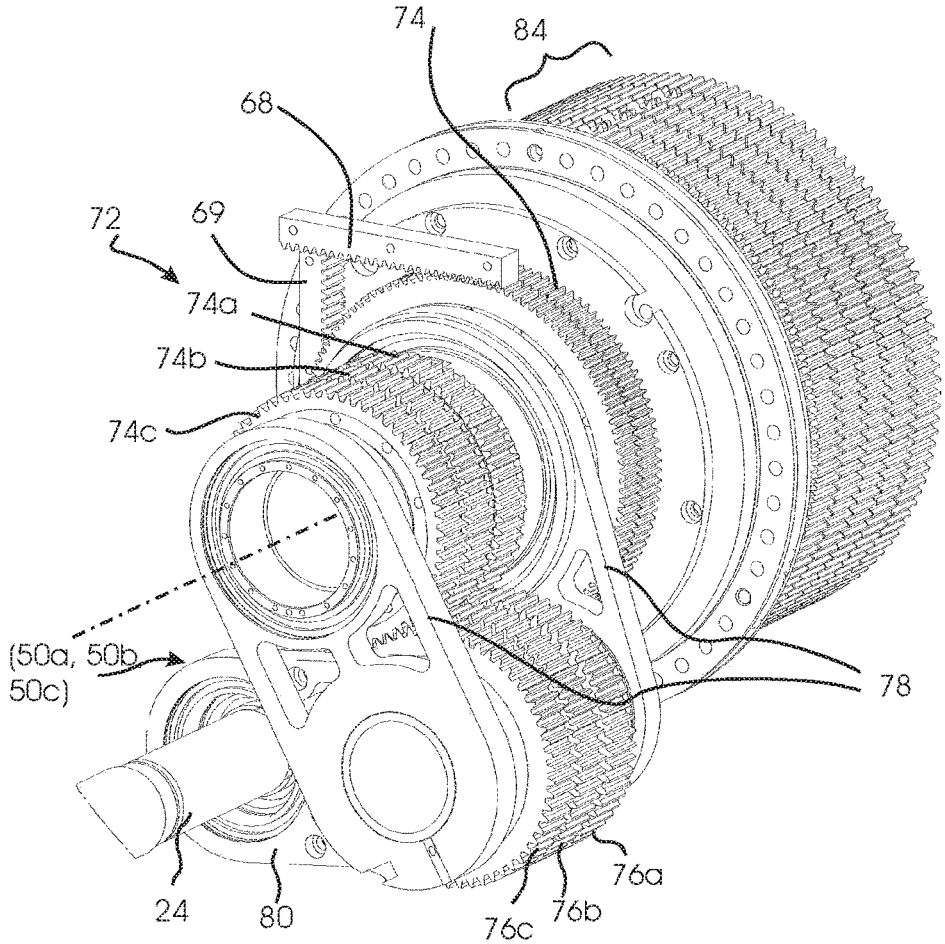
FIG. 11 shows a perspective view of elements of the coupling device.

As can be seen in FIGS. 9 and 11, the drive disks 84 are rotatably arranged about the pipe penetration 28 and hence the longitudinal axis L of a pipe 20 accommodated therein. As can be seen in FIG. 9, each of the individual drive disks 84 coupled to the motor drives 13*b* to 13*g* is coupled to associated drive wheels 74 of the positioning device 62 by one hollow shaft 86 penetrating the head plate 60. In this manner, the controllable motor drives 13*b* to 13*g* can drive and specify the rotary position to the drive wheels 74.

In so doing, the head plate 60 of the bending head 22 is directly coupled to a first drive disk to thereby enable a controlled rotation of the head plate 60 and the entire positioning device 62 fastened thereto with the housing 40 about the longitudinal axis L. The second motor drive 13*b* schematically portrayed in FIG. 13 accordingly causes the entire bending head 22, and hence also the bending tool 26 arranged on the tool holder 25, to rotate by the coupling that is also only schematically portrayed in FIG. 13.

With the third and fourth motor drive 13*c*, 13*d*, the lift and offset movements of the slides 64, 66 of the positioning device 62 are controlled by rack and pinion drives as already explained in association with FIG. 10. Accordingly, the X/Y position of the bending tool 26 can be specified.

With the fifth, sixth and seventh motor drive 13*e* to 13*g*, three drive gears 74*a*, 74*b*, 74*c* of the positioning device 62 are activated by a belt coupling, drive disks 84 and hollow shafts 83 as described. These are coupled by the coupling device 72 to the three drive pinions 50*a*, 50*b*, 50*c* at the end of the tool holder 24 as explained in association with FIG. 12*a* bis 12*c*. Accordingly the rotary movement of the radius roller 30 can be specified by the fifth motor drive 13*e*, the pivot movement of the sliding block 32 can be specified by the sixth motor drive 13*f*, and the pivot movement of the counter holder 34 can be specified by the seventh motor drive 13*g*.

Accordingly, by activating the motor drives 13*a* to 13*g*, the control device 82 can control all the movements of the bending tower 14, bending head 22 and bending tool 26 to assume a respective desired bending position, to position the bending tool 26 there in the desired alignment relative to the pipe 20 and finally to generate the desired bend by activating the bending tool 26.

The lift and offset movements that can be specified by activating the drives 13*c* and 13*d* can on the one hand serve to position the bending tool 26 relative to the pipe 20 so that an appropriate pair of the various grooves 36, 38 of the bending tool is brought into contact with the pipe 20. On the other hand by specifying a path of travel in the X/Y direction, a change of the contact side of the radius roller 30, sliding block 32 and counter holder 34 can be achieved to switch the bending direction to, for example, switch from bending to the right to bending to the left. An activation sequence that is suitable for this could for example first specify a lift in the negative Y direction to remove the bending tool 26 from the pipe 20, then a displacement movement in the X direction to bring the bending tool 26 to the other side of the pipe, and finally a lifting movement in the positive Y direction in order to move the bending tool on the opposite side up to the pipe 20. At the same time, it is always useful to position the sliding block 32 and counter holder 34 in neutral positions during these movements so that the bending tool 26 can be freely positioned on the pipe 20. When specifying the activations for the motor drives 13*e* to 13*g*, the control device 82 takes into account the compensation angle to be calculated from the X/Y displacement position.

The described design of the pipe bending machine 10 depicted in the drawings with the embodiment of the bending tower 14, clamping device 12, bending head 22, positioning device 62 and bending tool 26 shown in the drawings and described above, is accordingly suitable for generating highly complex bending geometries, even for pipelines that for example have sections with different diameters, flexible hose sections, connecting pieces and other special features.

Changes are also possible in comparison to the depicted and described embodiments. In particular, the bending tool 26 can also have more or fewer movable elements instead of three movable parts (counter holder 34, sliding block 32, radius roller 30). The number of tool drive shafts in the tool holder 24 would then also need to be adapted as well as the number of coupling devices 72 and drive devices therefor. Likewise, the positioning device 62 could be simplified when only one displacement in a single direction is needed instead of the movement in the X and Y directions.

Moreover, the arrangement of the motor drives 13 *b-g* on the rear of the bending tower 14 and the transmission of the drive movement via drive disks 84 and hollow shafts 86 are preferred; nonetheless, this can also be achieved differently in alternative embodiments.

The invention claimed is:

1. A method for the bending of strand-shaped workpieces, comprising:

arranging a strand-shaped workpiece in a holder, and positioning a bending tool relative to the workpiece using a positioning device, the bending tool at least comprising a radius part and a bending part, the bending part being pivotable about the radius part, wherein the bending tool is driven by at least one tool driveshaft that extends in a longitudinal direction, wherein the bending tool is positioned relative to the workpiece by the positioning device such that a displacement of the bending tool and the tool driveshaft is enabled in at least one transverse direction that runs transversely to the longitudinal direction, wherein a drive wheel is rotatably arranged around an axis that is fixed relative to the workpiece and is coupled via a transmission device to drive the tool driveshaft, and wherein the transmission device comprising at least one coupling element that moves transversely to the axis of the drive wheel is activated to operate the bending tool.

2. A device for the bending of strand-shaped workpieces including:

a holder for a strand-shaped workpiece;

a bending tool, at least comprising a radius part and a bending part, wherein the workpiece can be bent by pivoting the bending part about the radius part;

at least one tool driveshaft extending in a longitudinal direction for driving the bending tool; and a positioning device for positioning the bending tool relative to the workpiece, wherein the positioning device enables a displacement of the bending tool and the tool driveshaft in at least one transverse direction that runs transversely to the longitudinal direction;

wherein a drive wheel is rotatably arranged around an axis that is fixed relative to the workpiece and is coupled via a transmission device to the drive of the tool driveshaft;

and wherein the transmission device comprises at least one coupling element movable transversely to the axis of the drive wheel.

3. The device according to claim 2, wherein:

the holder is oriented in the device so that the workpiece is aligned in the longitudinal direction.

4. The device according to claim 2, wherein:

the positioning device is enables a displacement of the bending tool in different directions within a plane arranged transverse to the longitudinal direction.

5. The device according to claim 2, wherein:

the positioning device comprises at least one slide that can be displaced in east one transverse direction;

wherein at least one slide drive device is provided to move the slide.

6. The device according to claim 5, wherein:

a first slide is provided that is displaceably guided in a first transverse direction;

and a second slide is provided that is displaceably guided in a second transverse direction.

7. The device according to claim 2, wherein:

the positioning device enables a rotation of the bending tool about the longitudinal direction.

8. The device according to claim 2, wherein:

the drive wheel is designed as a drive gear;

at least one drive pinion is provided on the tool driveshaft;

and the at least one coupling element is designed as a coupling gear which is engaged with the drive pinion and the drive wheel.

9. The device according to claim 8, wherein:

the coupling gear is connected in each case to the drive pinion and the drive gear by spacing elements such that when the drive pinion moves in the transverse direction, the coupling gear remains engaged with the drive pinion and the drive gear.

10. The device according to claim 2, wherein:

a motor drive is coupled to the drive wheel; and an activation device specifies an activation of the motor drive depending on the displacement in transverse direction.

11. The device according to claim 10, wherein:

the activation device specifies a compensating rotation of the drive wheel during the displacement in transverse direction such that a change in the rotary angle relationship caused by the displacement between the drive wheel and the drive pinion is compensated by compensating rotation.

12. The device according to claim 2, wherein:

the drive wheel is coupled via a transmission shaft to a drive disk;

wherein the drive disk can be driven by a motor drive.

13. The device according to claim 2, wherein:

the drive wheel is rotatably arranged about a common axis with at least one additional drive wheel, wherein the drive wheels are coupled to drive disks via coaxial hollow shafts;

wherein a bushing for the workpiece is provided within the hollow shafts.

14. The device according to claim 13, wherein:

the other drive wheel is provided as a drive for at least one of:

shifting the bending tool in transverse direction; and rotating the bending tool about the longitudinal direction.

15. The device according to claim 2, wherein:

the holder for the workpiece comprises a clamping device for clamping the workpiece and a bushing for the workpiece.

* * * * *